US007625454B2

(12) United States Patent
Lin et al.

(10) Patent No.: US 7,625,454 B2
(45) **Date of Patent: *Dec. 1, 2009**

(54) AL-SI-MG-ZN-CU ALLOY FOR AEROSPACE AND AUTOMOTIVE CASTINGS

(75) Inventors: Jen C. Lin, Export, PA (US); Xinyan Yan, Murrysville, PA (US); Cagatay Yanar, Pittsburgh, PA (US); Larry D. Zellman, Yorktown, VA (US); Xavier Dumant, Laval (FR); Robert Tombari, Dollard des Ormeaux (CA)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/191,757

(22) Filed: Jul. 28, 2005

(65) Prior Publication Data

US 2006/0021683 A1 Feb. 2, 2006

Related U.S. Application Data

(60) Provisional application No. 60/592,051, filed on Jul. 28, 2004.

(51) Int. Cl.
*C22C 21/02* (2006.01)

(52) U.S. Cl. ..... 148/549; 148/698; 148/417; 420/532; 420/548

(58) Field of Classification Search ..... 148/549, 148/698, 417; 420/532, 548
See application file for complete search history.

(56) References Cited

U.S. PATENT DOCUMENTS 5,846,347 A * 12/1998 Tanaka et al. ..... 148/439
7,087,125 B2 * 8/2006 Lin et al. ..... 148/417
2005/0161128 A1 * 7/2005 DasGupta ..... 148/549

FOREIGN PATENT DOCUMENTS

JP 56163234 A * 12/1981

OTHER PUBLICATIONS

"ASM Handbook Vol. 15 Casting", ASM International, 1988, p. 327,332-334,743-746,754,757-759,767.*
Japanese Translation for International Application No. JP 2007-523726, based on corresponding PCT application No. PCT/US2005/026478, filed Mar. 26, 2007.
Mexican National Phase Application No. MX/a/2007/001008 filed on Jan. 25, 2007, based on corresponding PCT application No. PCT/US2005/026478.
Norwegian National Phase Application No. NO20071075, filed on Feb. 26, 2007 based on corresponding PCT application No. PCT/US2005/026478.

* cited by examiner

*Primary Examiner*—Roy King
*Assistant Examiner*—Janelle Morillo
(74) *Attorney, Agent, or Firm*—Greenberg Traurig, LLP

(57) ABSTRACT

The present invention provides an aluminum casting alloy with a composition including 4%-9% Si; 0.1%-0.7% Mg; less than or equal to 5% Zn; less than 0.15% Fe; less than 4% Cu; less than 0.3% Mn; less than 0.05% B; less than 0.15% Ti; and the remainder consisting essentially of aluminum. The inventive AlSiMg composition provides increased mechanical properties (Tensile Yield Strength and Ultimate Tensile Strength) in comparison to similiarly prepared E357 alloy at room temperature and high temperature. The present invention also includes a shaped casting formed from the inventive composition and a method of forming a shaped casting from the inventive composition.

25 Claims, 8 Drawing Sheets

| ALLOY | COMPOSITION | | | | | | | | TYS | UTS | E | Q |
|---|---|---|---|---|---|---|---|---|---|---|---|---|
| | Mg | Cu | Mn | Si | Fe | Sr | Ag | Al | (Mpa) | (MPa) | (%) | (Mpa) |
| | 0.608 | 1.01 | 0.003 | 7.051 | 0.044 | 0.0008 | 0 | Bal. | 322.3 | 387. | 4 | 478.2 |
| | 0.708 | 1.03 | 0.003 | 7.123 | 0.046 | 0.0008 | 0 | Bal. | 330.3 | 377.8 | 4.7 | 478.4 |
| | 0.6044 | 1.504 | 0.0033 | 6.985 | 0.047 | 0.0008 | 0 | Bal. | 342.3 | 401.3 | 4.3 | 495.8 |
| | 0.604 | 2.017 | 0.004 | 7.048 | 0.047 | 0.0008 | 0 | Bal. | 344.5 | 403.2 | 3.7 | 489.0 |
| | 0.714 | 1.987 | 0.004 | 6.909 | 0.053 | 0.0008 | 0 | Bal. | 347.5 | 395.0 | 2.6 | 458.3 |
| | 0.623 | 1.977 | 0.004 | 6.803 | 0.053 | 0.0008 | 0.504 | Bal. | 337.4 | 392.9 | 3.9 | 481.1 |
| | 0.622 | 0.997 | 0.003 | 7.02 | 0.056 | 0.0074 | 0 | Bal. | 342.9 | 398.1 | 3.9 | 482.1 |
| E357 | 0.6 | 0 | 0.005 | 7.0 | 0.05 | 0.0008 | 0 | Bal. | 275 | 345 | 5 | 450 |

*FIG. 9*

AL-SI-MG-ZN-CU ALLOY FOR AEROSPACE AND AUTOMOTIVE CASTINGS

CROSS REFERENCE TO RELATED APPLICATIONS

This application claims the benefit of U.S. Provisional Application Ser. No. 60/592,051, filed on Jul. 28, 2004; the disclosure of which is fully incorporated by reference herein.

FIELD OF THE INVENTION

The present invention relates to aluminum alloys and, more particularly, it pertains to aluminum casting alloys comprising silicon (Si), magnesium (Mg), zinc (Zn), and copper (Cu).

BACKGROUND OF THE INVENTION

Cast aluminum parts are widely used in the aerospace and automotive industries to reduce weight. The most common cast alloy used, Al—$Si_7$—Mg has well established strength limits. At present, cast materials in E357, the most commonly used Al—Si7-Mg alloy, can reliably guarantee Ultimate Tensile Strength of 310 MPa, (45,000 psi), Tensile Yield Strength of 260 MPa (37,709 psi) with elongations of 5% or greater at room temperature. In order to obtain lighter weight parts, material with higher strength and higher ductility is needed with established material properties for design.

A variety of alternative alloys exist and are registered that exhibit higher strength. However these also exhibit potential problems in castability, corrosion potential or fluidity that are not readily overcome and are therefore less suitable for use. Therefore, a need exists to have an alloy with higher mechanical properties than the Al—Si7-Mg alloys, such as E357, which also has good castability, corrosion resistance, and other desirable properties.

SUMMARY OF THE INVENTION

The present invention provides an inventive AlSiMg alloy having increased mechanical properties, a shaped casting produced from the inventive alloy, and a method of forming a shaped casting produced from the inventive alloy. The inventive AlSiMg alloy composition includes Zn, Cu, and Mg in proportions suitable to produce increased mechanical properties, including but not limited to Ultimate Tensile Strength (UTS) and Tensile Yield Strength (TYS), in comparison to prior AlSi7Mg alloys, such as E357.

In one aspect, the present invention is an aluminum casting alloy consisting essentially of:

4%-9% Si;
0.1%-0.7% Mg;
less than or equal to 5% Zn;
less than 0.15% Fe;
less than 4% Cu;
less than 0.3% Mn;
less than 0.05% B;
less than 0.15% Ti; and
the remainder consisting essentially of aluminum.

It is noted that the above percentages are in weight % (wt %). In some embodiments of the present invention, the proportions of Zn, Cu, and Mg are selected to provide an AlSiMg alloy with increased strength properties, as compared to prior AlSi7Mg alloys, such as E357. In one embodiment of the present invention, the term "increased strength properties" denotes an increase of approximately 20%-30% in the Tensile Yield Strength (TYS) and approximately 20%-30% in the Ultimate Tensile Strength (UTS) of T6 temper investment castings in room temperature or high temperature applications, in comparison to similarly prepared castings of E357, while maintaining similar elongations to E357.

In some embodiments of the present invention, the Cu content of the alloy is increased to increase the alloy's Ultimate Tensile Strength (UTS) and Tensile Yield Strength (TYS) at room temperature (22° C.) and at high temperatures, wherein high temperature ranges from 100° C. to 250° C., preferably being at 150° C. Although, it is understood that with increasing temperature the Ultimate Tensile Strength (UTS) and Tensile Yield Strength (TYS) generally decreases, it is noted that the incorporation of Cu generally increases high temperature strength properties when compared to similar AlSiMg alloys without the incorporation of Cu. In one embodiment of the present invention, the Cu content is minimized to increase high temperature elongation. It is further noted that Elongation (E) typically increases with higher temperatures.

In some embodiments of the present invention, the Cu content and the Mg content of the alloy is selected to increase the alloy's Ultimate Tensile Strength (UTS) and Yield Tensile Strength (YTS) at room temperature (22° C.) and at high temperatures. In some embodiments of the present invention, the Zn content may increase an alloy's elongation in compositions having Cu and a higher Mg concentration. In some embodiments of the present invention, the Zn content can decrease the alloy's elongation in compositions having Cu and lower Mg concentrations. In addition to the incorporation of Zn effecting elongation at room temperature, similar trends are observed at high temperature.

In some embodiments of the present invention, the Cu composition may be less than or equal to 2% and the Zn composition may range from approximately 3% to approximately 5%, wherein increased Zn concentration within the disclosed range generally increases the alloy's Ultimate Tensile Strength (UTS) and Yield Tensile Strength (TYS). It has also be realized that the incorporation of Zn into alloy compositions of the present invention with a Cu concentration greater than 2% generally slightly decreases the Ultimate Tensile Strength (UTS) of the alloy. In one embodiment, the Zn content is reduced to less than 3% when the Cu content is greater than 2%. In one embodiment, the Zn content may be 0% when the Cu content is greater than 2%. In another embodiment of the present invention, the Cu, Zn and Mg content is selected to provide increased elongation, wherein the incorporation of Mg has a positive impact (increases elongation) on the inventive alloy when the Zn content is less than about 2.5 wt % and a negative impact (decreases elongation) when the Zn content is greater than 2.5 wt %. In one embodiment of the present invention the Ultimate Tensile Strength (UTS) of the alloy may be increased with the addition of Ag at less than 0.5 wt %.

In some embodiments of the present invention, the Mg, Cu and Zn concentrations are selected to have a positive impact on the Quality Index of the alloy at room and high temperatures. The Quality Index is an expression of strength and elongation. Although the incorporation of Cu increases the alloy's strength there can be a trade off in decreasing the alloys elongation, which in turn reduces the alloys Quality Index. In one embodiment, Mg is incorporated into the inventive alloy comprising Cu and greater than 1 wt % Zn in order to increase the Quality Index of the alloy. Further, Zn can increase the Quality Index when both the Mg content is high, such as on the order of 0.6 wt %, and the Cu content is low, such as less than 2.5 wt %.

The inventive alloy is for use in F, T5 or T6 heat treatment. The fluidity of the alloy is also improved when compared with the E357

In another aspect, the present invention is a shaped casting consisting essentially of:

4%-9% Si;
0.1%-0.7% Mg;
less than or equal to 5% Zn;
less than 0.15% Fe;
less than 4% Cu;
less than 0.3% Mn;
less than 0.05% B;
less than 0.15% Ti; and
the remainder consisting essentially of aluminum.

In an additional aspect, the present invention is a method of making a shaped aluminum alloy casting, the method comprising: preparing a molten metal mass consisting essentially of:

4%-9% Si;
0.1%-0.7% Mg;
less than or equal to 5% Zn;
less than 0.15% Fe;
less than 4% Cu;
less than 0.3% Mn;
less than 0.05% B;
less than 0.15% Ti;
the remainder consisting essentially of aluminum; and
forming an aluminum alloy product from said molten metal mass.

In one embodiment of the inventive method, forming the aluminum alloy product comprises casting the molten metal mass into an aluminum alloy casting by investment casting, low pressure or gravity casting, permanent or semi-permanent mold, squeeze casting, die casting, directional casting or sand mold casting. The forming method may further comprise preparing a mold with chills and risers. In one embodiment of the present invention, the molten metal mass is a thixotropic metal mass and forming the aluminum alloy product comprises semi-solid casting or forming.

BRIEF DESCRIPTION OF THE DRAWINGS

FIG. 9 presents a Table including alloy compositions in accordance with the present invention and includes one prior art alloy (E357) for comparative purposes. FIG. 9 also includes Ultimate Tensile Strength (UTS), Tensile Yield Strength (TYS), Elongation (E), and Quality Index (Q) for each listed alloy composition taken from an investment cast test specimen with T6 heat treatment at a temperature on the order of 150° C.

DETAILED DESCRIPTION OF THE PRESENT INVENTION

Table 1 presents compositions of various alloys, according to the present invention, and the prior art alloy, E357, which is included for comparison. Various tests, including tests of mechanical properties, were performed on the alloys in Table 1, and the results of the tests are presented in FIG. 1*a* through FIG. 5.

TABLE 1

| | Alloy Compositions | | | | | | | |
|---|---|---|---|---|---|---|---|---|
| Alloy | Cu | Zn | Si | Mg | Fe | Ti | B | Sr |
| 3Cu0Zn | 2.91 | 0 | 7.01 | 0.5 | 0.06 | 0.126 | 0.0006 | 0.01 |
| 3Cu2Zn | 2.9 | 1.83 | 7.1 | 0.49 | 0.06 | 0.127 | 0.0012 | 0.009 |
| 3Cu4Zn | 2.96 | 3.61 | 7.18 | 0.49 | 0.06 | 0.126 | 0.0007 | 0.008 |
| 1Cu0Zn | 1.0 | 0 | 7.03 | 0.5 | 0.02 | 0.12 | 0.0015 | 0.01 |
| 1Cu2Zn | 1.0 | 1.74 | 7.22 | 0.56 | 0.06 | 0.133 | 0.0003 | 0.009 |
| 1Cu4Zn | 0.99 | 3.39 | 7.36 | 0.54 | 0.05 | 0.131 | 0.0001 | 0.009 |
| 0Cu2Zn | 0 | 1.73 | 7.19 | 0.53 | 0.05 | 0.129 | 0.0014 | 0.006 |
| 0Cu4Zn | 0 | 3.41 | 7.19 | 0.53 | 0.05 | 0.127 | 0.0013 | 0.005 |
| E357 | 0 | 0 | 7.03 | 0.53 | 0.05 | 0.127 | 0.0011 | 0.007 |

The values in columns 2-8 of Table 1 are actual weight percentages of the various elements in the samples that were tested. All the entries in column 1 except the entry in the last row are target values for copper and zinc in the alloy. The entry in the last row specifies the prior art alloy, E357.

The columns following the first column in Table 1 present actual weight percentages of Cu, Zn, Si, Mg, Fe, Ti, B, and Sr, respectively.

Samples having the compositions cited in Table 1 were cast in directional solidification test molds for mechanical properties evaluation. The resulting castings were then heat treated to a T6 condition. Samples were taken from the castings in different regions having different solidification rates. Tensile properties of the samples were then evaluated at room temperature.

Figure 1A:
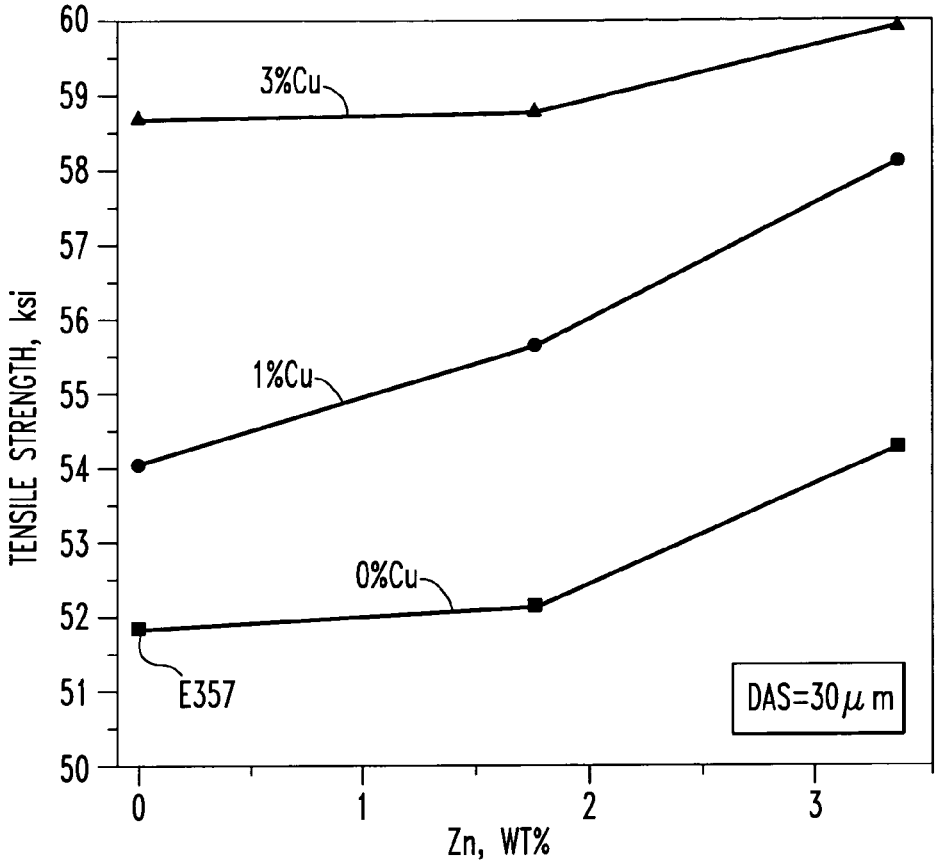
FIG. 1*a* presents tensile strength data for samples of aluminum alloys at room temperature containing about 7% Si, about 0.5% Mg, and further containing various amounts of Zn and Cu, directionally solidified at 1° C. per second.

Attention is now directed to FIG. 1*a*, which presents tensile strength data for aluminum alloy samples containing about 7% Si, 0.5% Mg, and various concentrations of Cu and Zn, as indicated. The samples cited in FIG. 1 were solidified at about 1° C. per second. For these samples, the dendrite arm spacing (DAS) was about 30 microns. It can be seen that the tensile strength of the alloy increases with Zn concentration up to the highest level studied, which was about 3.61% Zn. Likewise, the tensile strength increases with increasing copper concentration up to the highest level studied, which was about 3% Cu. All the samples having Cu and/or Zn additions had strength greater than the prior art alloy, E357.

Figure 1B:
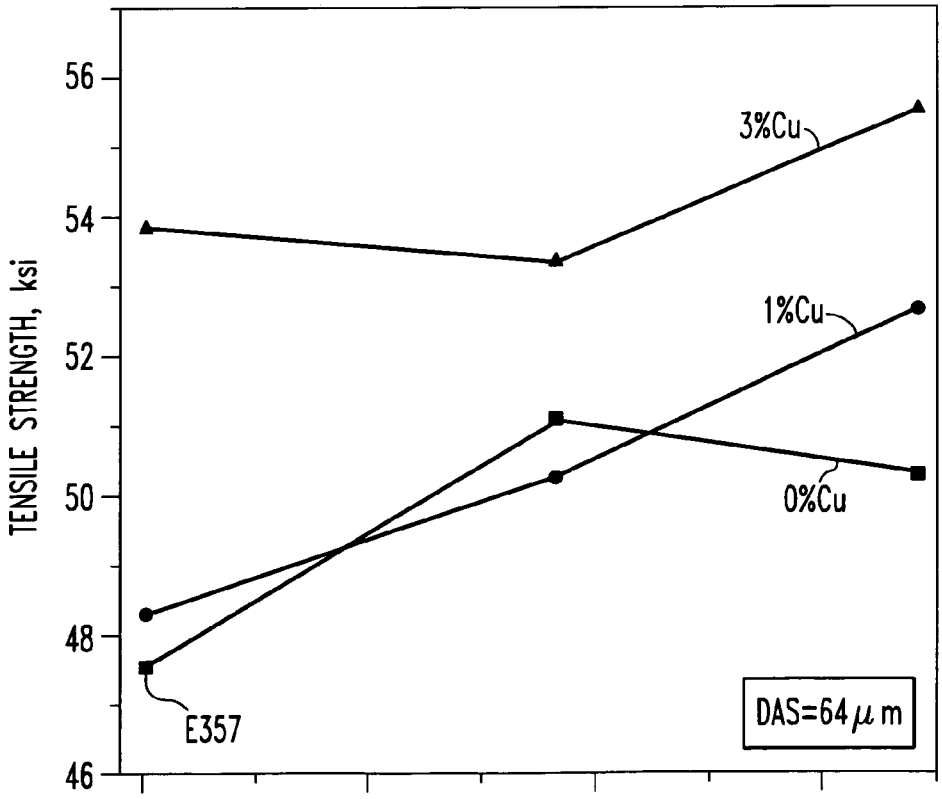
FIG. 1*b* presents tensile strength data for samples of aluminum alloys at room temperature containing about 7% Si, about 0.5% Mg, and further containing various amounts of Zn and Cu, directionally solidified at 0.4° C. per second.

FIG. 1*b* presents data similar to FIG. 1*a*, except that the samples shown in FIG. 1*b* were solidified more slowly, at about 0.4° C. per second, resulting in a dendrite arm spacing of about 64 microns. The sample having the greatest tensile strength was the sample having about 3% Cu and about 3.61% Zn. All the samples in FIG. 1*b* having Cu and/or Zn additions had strength greater than the prior art alloy, E357.

Figure 2A:
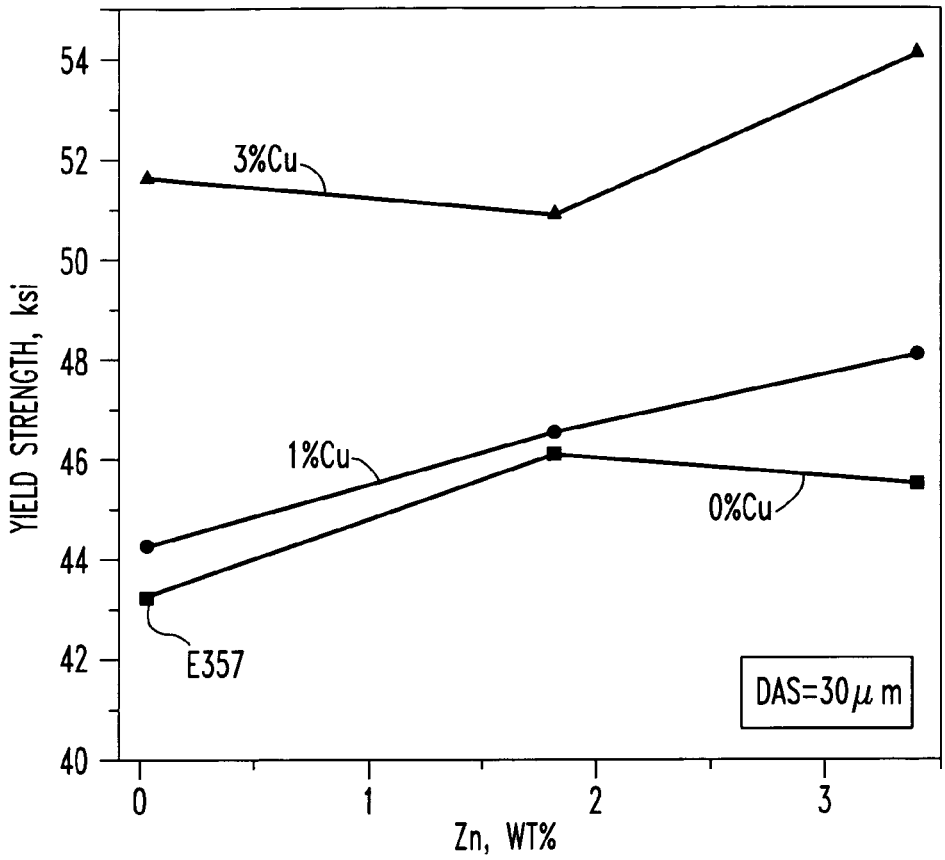
FIG. 2*a* presents yield strength data for samples of aluminum alloys at room temperature containing about 7% Si, about 0.5% Mg, and also containing various amounts of Zn and Cu, directionally solidified at 1° C. per second.

FIG. 2A presents yield strength data for various aluminum alloy samples having about 7% Si, about 0.5% Mg, and various concentrations of Cu and Zn. These samples were solidified at about 1° C. per second, and have a dendrite arm spacing of about 30 microns. The yield strength increased markedly with increases in Cu, and tended to increase with increases in Zn. The sample having the greatest yield strength had a copper concentration of about 3%, and a Zn concentration of about 4%. All the samples having added Cu or Zn exhibited greater yield strength than the prior art alloy, E357.

Figure 2B:
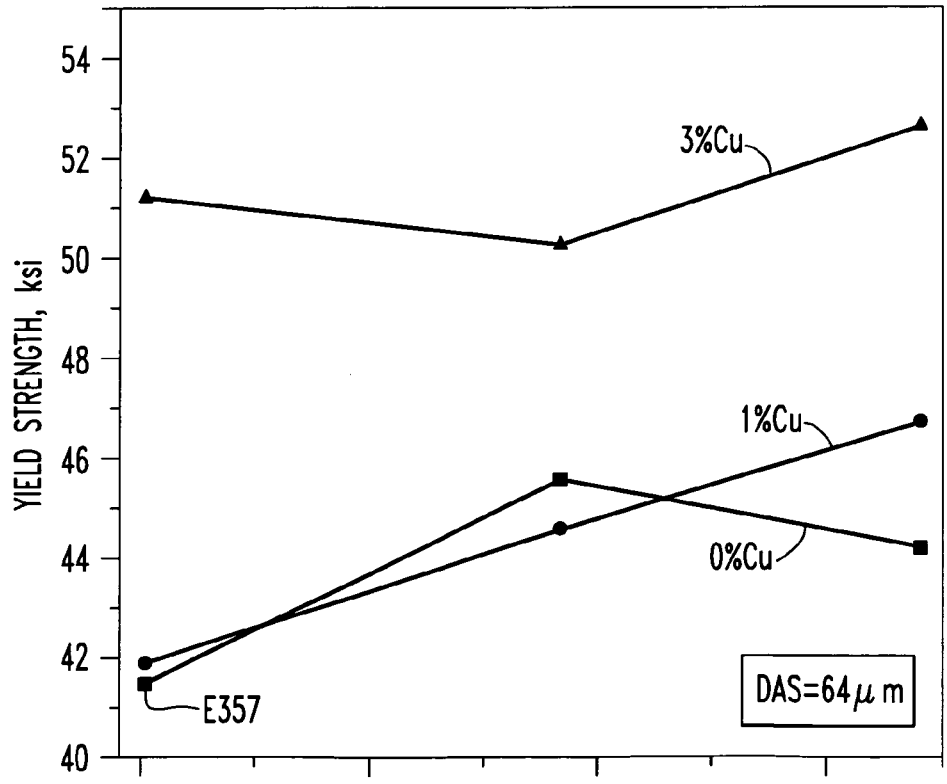
FIG. 2*b* presents yield strength data for samples of aluminum alloys at room temperature containing about 7% Si, about 0.5% Mg, and also containing various amounts of Zn and Cu, directionally solidified at 0.4° C. per second.

FIG. 2*b* presents yield strength data for the same aluminum alloys as shown in FIG. 2*a*; however, they were solidified more slowly, at about 0.4° C. per second. The corresponding dendrite arm spacing was about 64 microns. The sample having the greatest yield strength had a copper concentration of about 3%, and a Zn concentration of about 4%. All the samples having added Cu or Zn exhibited greater yield strength than the prior art alloy, E357.

Figure 3A:
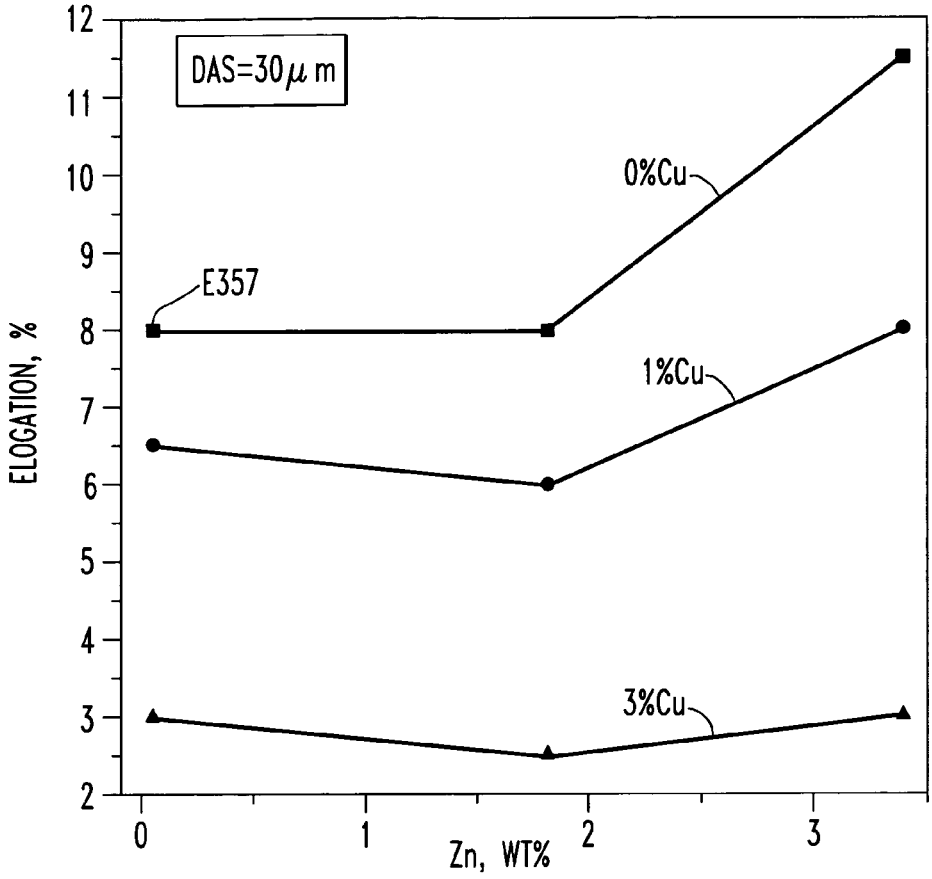
FIG. 3*a* presents elongation data for samples of aluminum alloys at room temperature containing about 7% Si, about 0.5% Mg, and also containing various amounts of Zn and Cu, directionally solidified at 1° C. per second.

FIG. 3*a* presents elongation data for the prior art alloy, E357, and various alloys having added Cu and Zn. The solidification rate was about 1° C. per second, and the dendrite arm spacing was about 30 microns. The best elongation is obtained for the alloys having 0% Cu. However, increasing the Zn concentration from 2% to about 4% caused increased elongation. The alloys having Zn between 2% and 4% had elongations greater than that of the prior art alloy, E357.

Figure 3B:
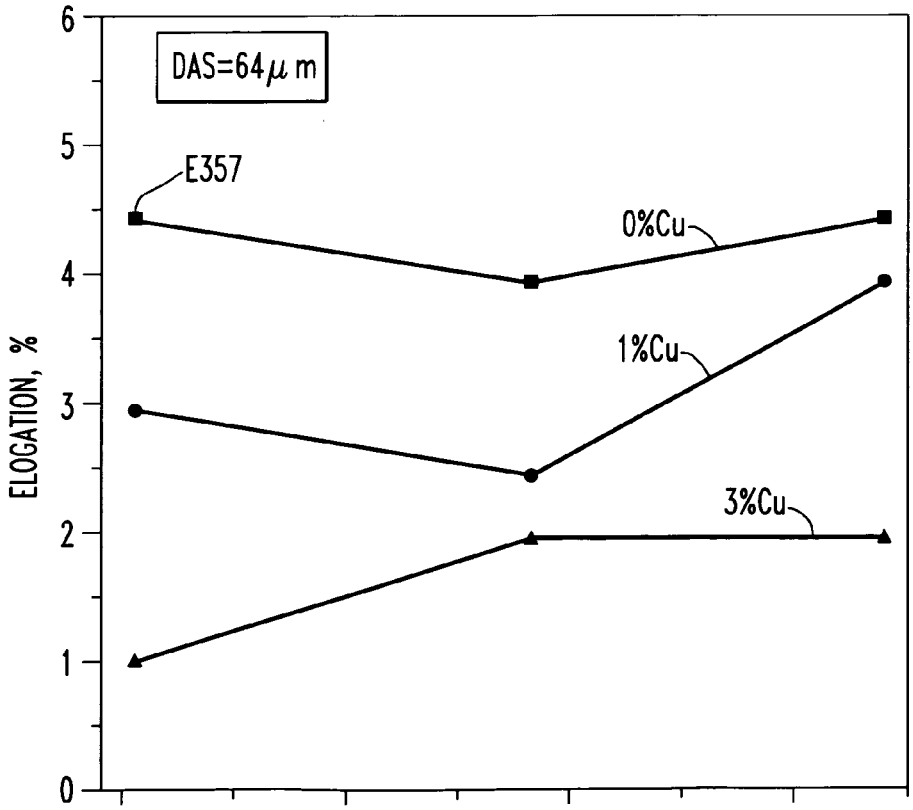
FIG. 3*b* presents elongation data for samples of aluminum alloys at room temperature containing about 7% Si, about 0.5% Mg, and also containing various amounts of Zn and Cu, directionally solidified at 0.4° per second.

FIG. 3*b* presents elongation data for the alloys shown in FIG. 3*a*, but solidified more slowly, at 0.4° C. per second. The dendrite arm spacing was about 64 microns. As before, the alloys having about 0% Cu had the greatest elongation. Indeed the greatest elongation was obtained for the prior art alloy, E357. However, the alloy with 0% Cu and Zn in a range from 2% to 4% was only slightly inferior to E357 in this regard. The alloys having Zn in the range from 2% to 4% are of interest because their tensile strength and yield strength values are superior to E357.

Figure 4:
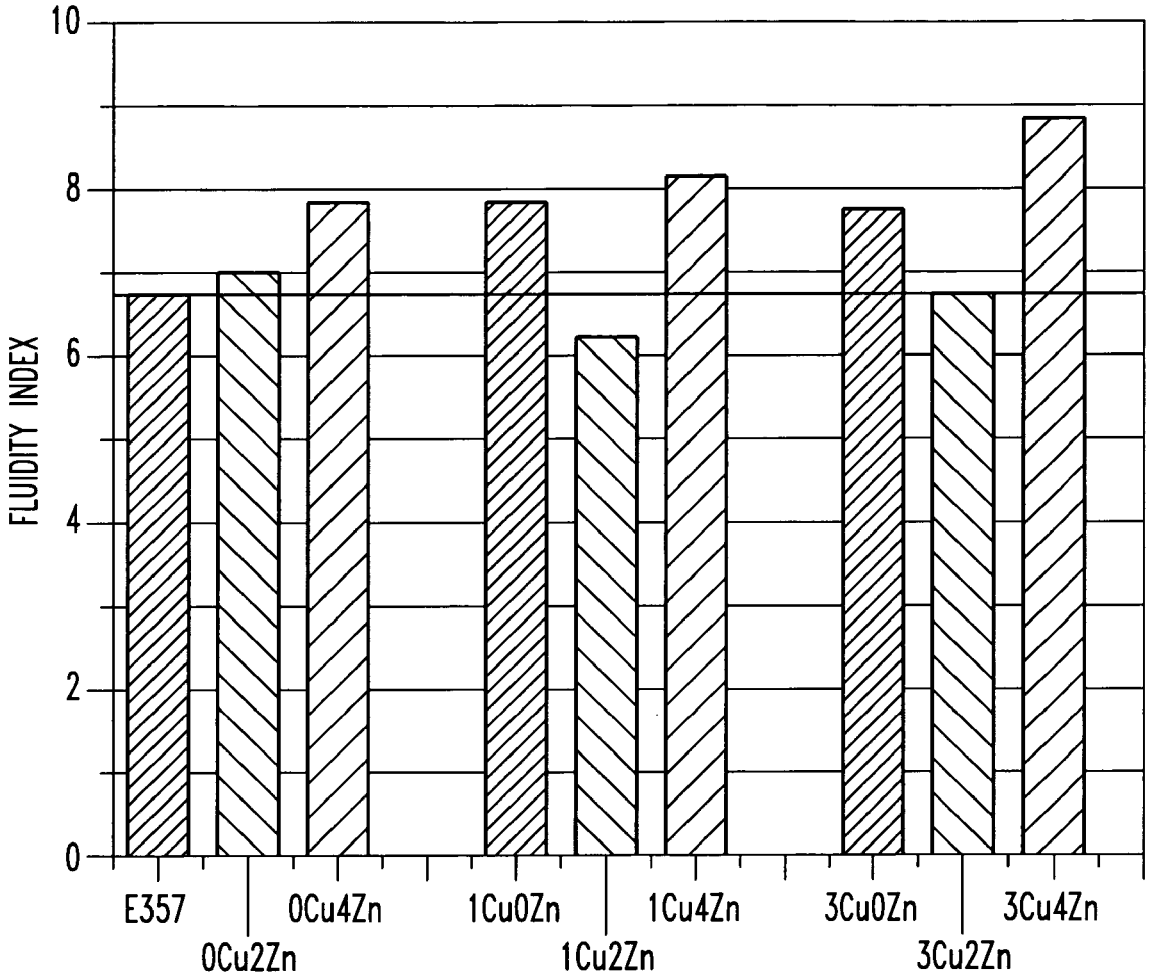
FIG. 4 presents the results of fluidity tests for samples of aluminum alloys containing about 7% Si, about 0.5% Mg, and also containing various amounts of Zn and Cu.

FIG. 4 presents the results of casting in a fluidity mold. As before, the tests were performed on aluminum alloys containing about 7% Si, about 0.5% Mg, and with various amounts of Cu and Zn. Most of the alloys in FIG. 4 having additions of Cu or Zn have fluidity superior to that of the prior art alloy, E357. Indeed, the best fluidity of all was obtained for 3% Cu, 4% Zn. Fluidity is crucial for shaped castings because it determines the ability of the alloy to flow through small passages in the mold to supply liquid metal to all parts of the casting.

Figure 5:
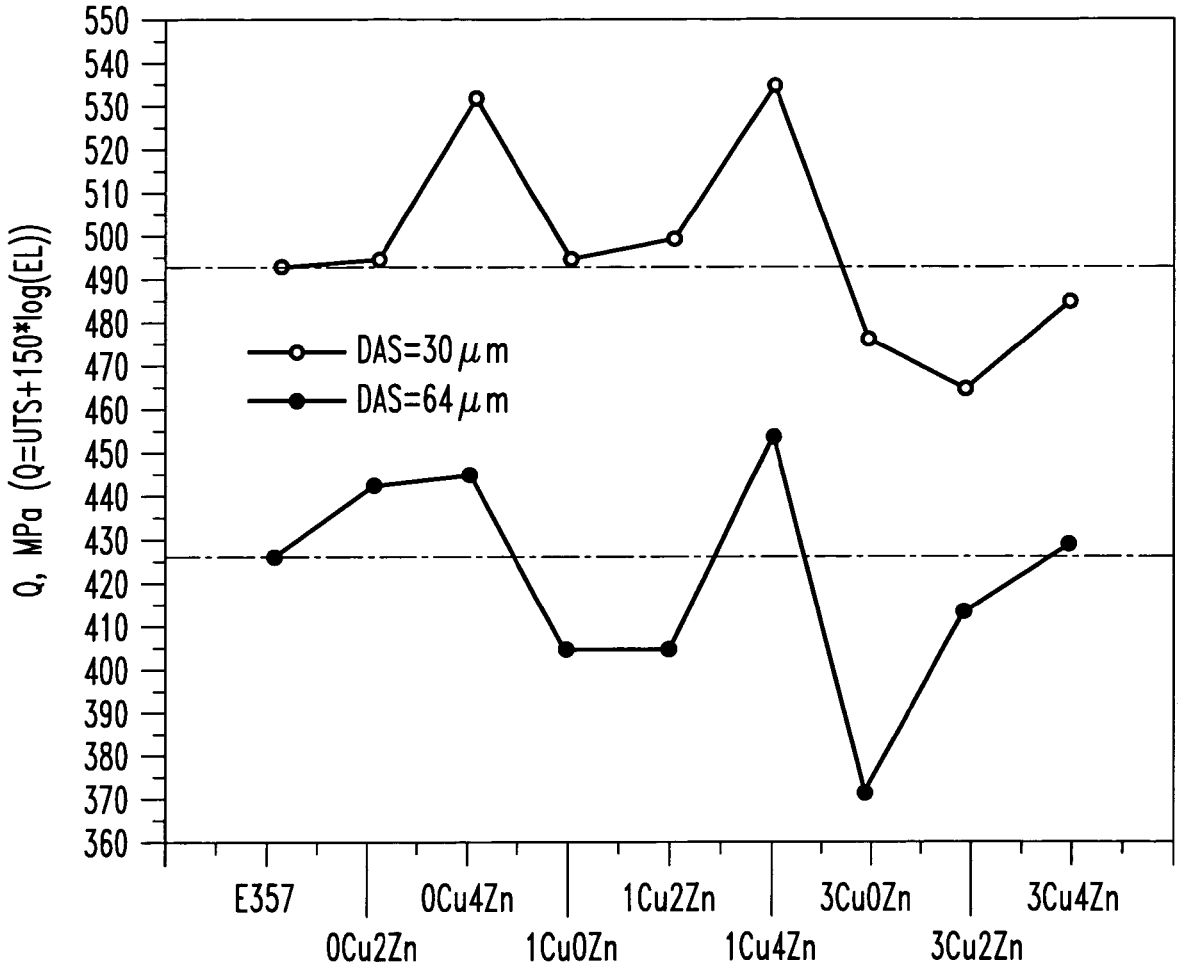
FIG. 5 presents the quality index at room temperature, which is based on ultimate tensile strength and elongation for samples of aluminum alloys containing about 7% Si, about 0.5% Mg, and also containing various amounts of Zn and Cu.

FIG. 5 presents data for the Quality Index (Q) for the alloys tested. The Quality Index (Q) is a calculated index that includes the Ultimate Tensile Strength (UTS) plus a term involving the logarithm of the Elongation (E). The two plots in FIG. 5 are for the two dendrite arm spacings employed for the preceding studies. The 30 micron spacing is found in samples cooled at 1° C. per second, and the 64 micron spacing is found in samples cooled at 0.4° C. per second. It can be seen from FIG. 5 that, generally, the best Quality Index (Q) is obtained for high concentrations of Zn, and for low concentrations of Cu.

Table 2 presents compositions of various alloys, according to the present invention, wherein the concentrations of Cu, Mg and Zn were selected to provide improved mechanical properties at room temperature and high temperature. The values in columns 2-7 of Table 2 are actual weight percentages of the various elements in the samples that were tested. The balance of each alloy consists essentially of aluminum. It is noted that Sr is included as a grain refiner.

TABLE 2

COMPOSITIONS OF INVESTMENT CAST AlSiMg TEST SPECIMENS

| Alloy | Cu | Zn | Si | Mg | Fe | Ti | Sr |
|---|---|---|---|---|---|---|---|
| 5Si1Cu0.6Mg | .99 | 0 | 4.9 | .56 | .1 | .12 | .006 |
| 7Si1Cu0.5Mg | 1.05 | 0 | 6.93 | .49 | .07 | .13 | .0004 |
| 7Si1Cu0.5Mg3Zn | 1.07 | 3.12 | 7.29 | .5 | .06 | .12 | .008 |
| 5Si1Cu0.5Mg | 1 | 0.03 | 5.01 | .57 | .08 | .12 | .006 |
| 5Si3Cu0.5Mg | 3.01 | 0 | 5.13 | .51 | .08 | .13 | .007 |
| 5Si3Cu0.5Mg3Zn | 3.27 | 3.17 | 5.34 | .5 | .07 | .12 | 0 |
| 5Si1Cu0.6Mg | 1.02 | 0.02 | 5 | .57 | .08 | .12 | .007 |
| 5Si1Cu0.6Mg3Zn | 1.11 | 3 | 5.19 | .56 | .08 | .11 | 0 |
| 5Si1Cu0.6Mg | 1.01 | .02 | 5.01 | .57 | .09 | .12 | .006 |
| 7Si3Cu0.6Mg | 3.11 | 0 | 7.1 | .61 | .05 | .13 | 0 |
| 7Si3Cu0.6Mg3Zn | 3.26 | 3.22 | 7.47 | .62 | .05 | .12 | .007 |
| 5Si1Cu0.6Mg | 1.01 | .03 | 5.03 | .57 | .08 | .12 | .007 |

Test specimens where produced from the above compositions for mechanical testing. The test specimens where formed by investment casting in the form of ¼" thick test plates. The cooling rate via investment casting is less than about 0.5° C. per second and provides a dendritic arm spacing (DAS) on the order of approximately 60 microns or greater. Following casting the test plates were then heat treated to T6 temper. Typically, T6 temper comprises solution heat treat, quench and artificial aging. The test plates where sectioned and their mechanical properties tested. Specifically, the test specimens comprising the alloy compositions listed in Table 2 where tested for Ultimate Tensile Strength (UTS) at room temperature (22° C.), Ultimate Tensile Strength (UTS) at high temperature (150° C.), Tensile Yield Strength (TYS) at room temperature (22° C.), Tensile Yield Strength (TYS) at high temperature (150° C.), Elongation (E) at high temperature (150° C.), Elongation (E) at room temperature (22° C.), Quality Index (Q) at high temperature (150° C.), and Quality Index (Q) at room temperature (22° C.). The results of the tests are presented in the following Table 3.

TABLE 3

MECHANICAL PROPERTIES OF TEST SPECIMENT HAVING THE ALLOY COMPOSITIONS LISTED IN TABLE 2.

| | Room Temperature (22° C.) | | | | High Temperature (150° C.) | | | |
|---|---|---|---|---|---|---|---|---|
| Alloy | TYS(MPa) | UTS(MPa) | E(%) | Q(MPa) | TYS(MPa) | UTS(MPa) | E(%) | Q(MPa) |
| 5Si1Cu0.6Mg | 337.27 | 369.99 | 2.8 | 437.84 | 307.98 | 325.90 | 6.0 | 442.62 |
| 7Si1Cu0.5Mg | 338.76 | 385.38 | 5.5 | 496.44 | 305.23 | 328.65 | 10.0 | 478.65 |
| 7Si1Cu0.5Mg3Zn | 346.45 | 392.39 | 4.7 | 492.74 | 310.74 | 332.79 | 7.7 | 465.76 |
| 5Si1Cu0.5Mg | 332.79 | 368.96 | 3.2 | 444.05 | 307.98 | 325.90 | 6.0 | 442.62 |
| 5Si3Cu0.5Mg | 373.09 | 404.33 | 2.0 | 449.48 | 334.17 | 361.73 | 4.0 | 452.03 |
| 5Si3Cu0.5Mg3Zn | 372.63 | 391.35 | 2.0 | 436.51 | 328.65 | 345.88 | 2.0 | 391.03 |
| 5Si1Cu0.6Mg | 335.31 | 373.09 | 3.2 | 448.18 | 307.98 | 325.90 | 6.0 | 442.62 |
| 5Si1Cu0.6Mg3Zn | 346.45 | 382.05 | 2.2 | 432.42 | 314.87 | 334.17 | 5.7 | 447.55 |
| 5Si1Cu0.6Mg | 329.34 | 371.03 | 4.0 | 461.34 | 307.98 | 325.90 | 6.0 | 442.62 |
| 7Si3Cu0.6Mg | 376.65 | 407.31 | 2.0 | 452.47 | 337.61 | 368.62 | 4.3 | 463.64 |
| 7Si3Cu0.6Mg3Zn | 379.06 | 401.34 | 2.0 | 446.50 | 333.48 | 352.77 | 5.0 | 457.61 |
| 5Si1Cu0.6Mg | 329.92 | 368.84 | 3.2 | 443.94 | 307.98 | 325.90 | 6.0 | 442.62 |

From the above data in Table 3, regression models for Tensile Yield Strength (TYS) at room temperature (22° C.), Ultimate Tensile Strength (UTS) at room temperature (22° C.), and Elongation (E) at room temperature (22° C.), where derived, as follows:

TYS (MPa) at Room Temperature (22° C.)=322.04−25.9466* Mg(wt %)+19.5276 Cu(wt %)−4.8189 Zn(wt %)+1.3576 Si(wt %)+19.08Mg(wt %) Zn(wt %)−2.1535 Cu(wt %) Zn(wt %)−119.57 Sr(wt %)

UTS (MPa) at Room Temperature (22° C.)=373.188−71.5565* Mg(wt %)+14.5255 Cu(wt %)−6.0743 Zn(wt %)+4.57744 Si(wt %)+23.212 Mg(wt %) Zn(wt %)−3.42964 Cu(wt %) Zn(wt %)+79.2381 Sr(wt %)

E(%) at Room Temperature (22° C.)=7.119−11.548*Mg (wt %)−1.055 Cu(wt %)−0.117 Zn(wt %)+0.739 Si(wt %)−0.801 Mg(wt %) Zn(wt %)+0.173 Cu(wt %) Zn(wt %)+16.903 Sr(wt %).

From the data in Table 3, regression models for Tensile Yield Strength (TYS) at high temperature (150° C.), Ultimate Tensile Strength (UTS) at high temperature (150° C.), Elongation (E) at high temperature (150° C.), and Quality Index (Q) at high temperature (150° C.) where derived, as follows:

TYS (MPa) at High Temperature (150° C.)=279.465+29.792*Mg(wt %)+14.0 Cu(wt %)+0.4823 Zn(wt %)−0.503 Si(wt %)+6.566 Mg(wt %) Zn(wt %)−1.998 Cu(wt %) Zn(wt %)−3.686 Sr(wt %).

UTS (MPa) at High Temperature (150° C.)=293.3+15.723*Mg(wt %)+18.32 Cu(wt %)+0.441 Zn(wt %)+1.2264 Si(wt %)+9.811 Mg(wt %) Zn(wt %)−3.7344 Cu(wt %) Zn(wt %)−145.682 Sr(wt %).

E (%) at High Temperature (150° C.)=13.575-20.454*Mg (wt %)−1.672 Cu(wt %)−4.812 Zn(wt %)+1.184 Si(wt %)+8.138 Mg(wt %) Zn(wt %)+0.014 Cu(wt %) Zn(wt %)−26.65 Sr(wt %).

Q(MPa) at High Temperature (150° C.)=447.359-138.331*Mg(wt %)−0.4381 Cu(wt %)−65.285Zn(wt %)+14.36 Si(wt %)+130.69 Mg(wt %) Zn(wt %)−6.043 Cu(wt %) Zn(wt %)+405.71 Sr(wt %).

Figure 6:
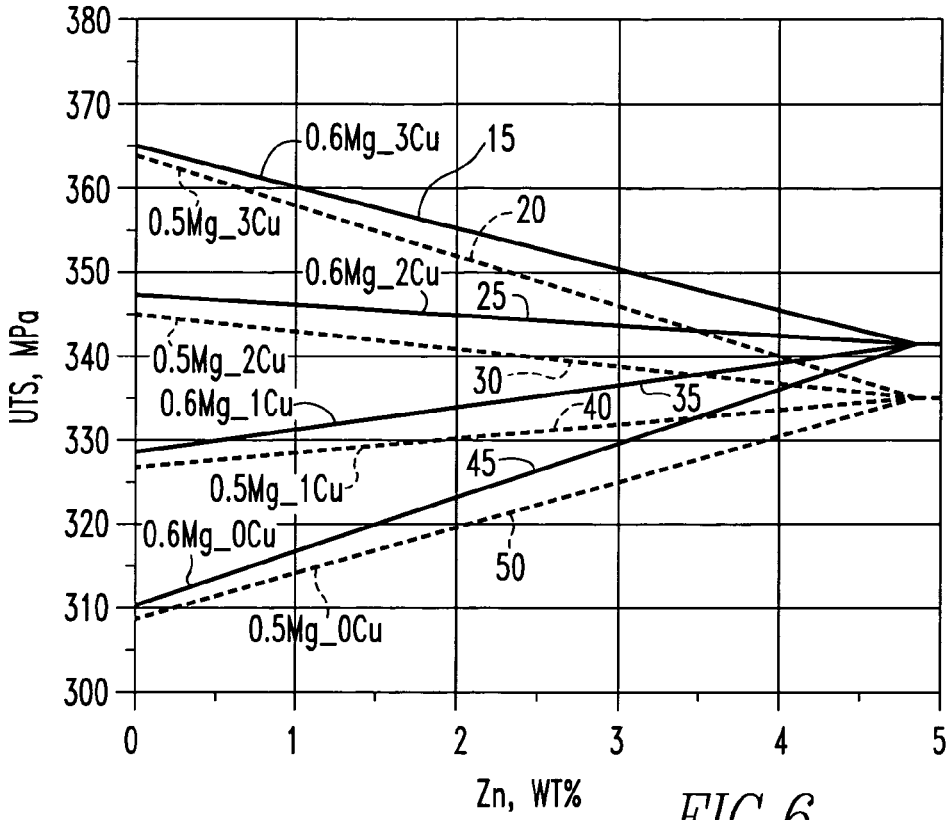
FIG. 6 presents a graph depicting the effects of Mg, Cu and Zn concentration on Ultimate Tensile Strength (UTS) at high temperature (approximately 150° C.) of 7Si—Mg—Cu—Zn alloy test specimens produced using investment casting and T6 heat treatment.
Figure 7:
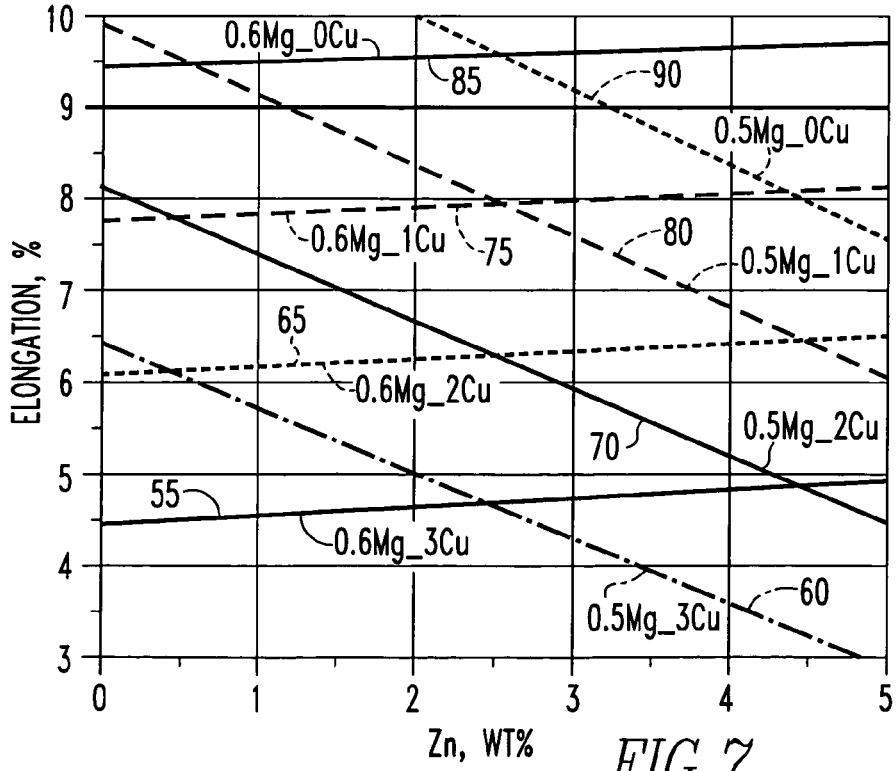
FIG. 7 presents a graph depicting the effects of Mg, Cu and Zn concentration on Elongation (E) at high temperature (approximately 150° C.) of test specimens comprising 7Si—Mg—Cu—Zn produced using investment casting and T6 heat treatment.
Figure 8:
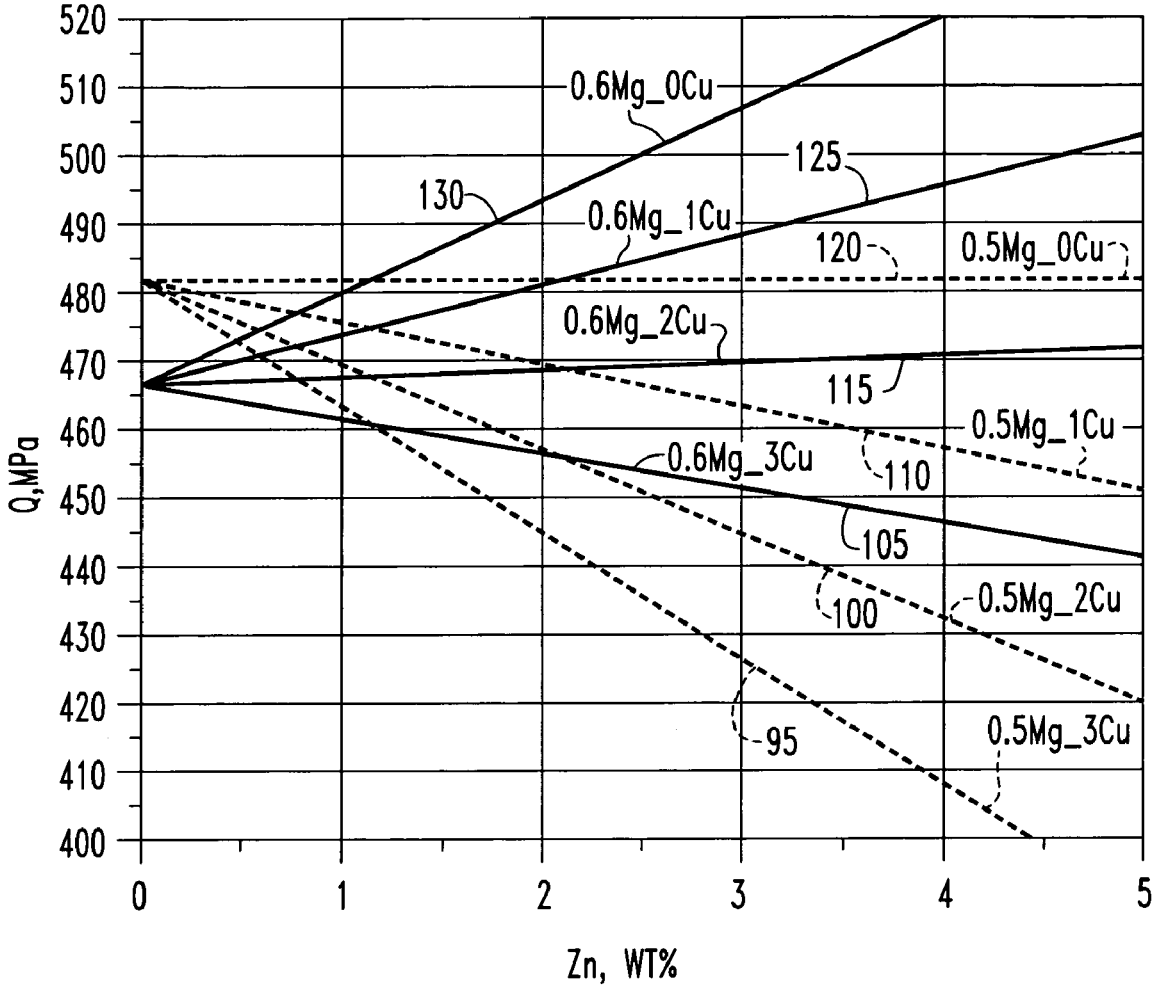
FIG. 8 presents a graph depicting the effects of Mg, Cu and Zn concentration on Quality Index (Q) at high temperature (approximately 150° C.) of test specimens comprising 7Si—Mg—Cu—Zn produced using investment casting and T6 heat treatment.

The above regression models for Ultimate Tensile Strength (UTS) at high temperature (150° C.), Elongation (E) at high temperature (150° C.), and Quality Index (Q) at high temperature (150° C.) where then plotted in FIGS. 6-8.

Referring to the graph depicted in FIG. 6, the Ultimate Tensile Strength (UTS) in MPa is plotted for alloy compositions at high temperature (150° C.) of varying Mg and Cu concentrations as a function of increasing Zn concentration (wt %). Specifically, reference line 15 indicates a plot of an alloy in accordance with the present invention comprising approximately 0.6 wt % Mg and 3 wt % Cu; reference line 20 indicates a plot of an alloy in accordance with the present invention comprising approximately 0.5 wt % Mg and 3 wt % Cu; reference line 25 indicates a plot of an alloy in accordance with the present invention comprising approximately 0.6 wt % Mg and 2 wt % Cu; reference line 30 indicates a plot of an alloy in accordance with the present invention comprising approximately 0.5 wt % Mg and 2 wt % Cu; reference line 35 is a plot of an alloy in accordance with the present invention comprising approximately 0.6 wt % Mg and 1 wt % Cu; reference line 40 is a plot of an alloy in accordance with the present invention comprising approximately 0.5 wt % Mg and 1 wt % Cu; reference line 45 is a plot of an alloy in accordance with the present invention comprising approximately 0.6 wt % Mg and 0 wt % Cu; and reference line 50 is a plot of an alloy in accordance with the present invention comprising approximately 0.5 wt % Mg and 0 wt % Cu.

According to the graph depicted in FIG. 6, as well as, the data provided in Table 3, it is noted that as the Cu concentration of the alloy is increased to approximately 2 wt % or greater the incorporation of Zn has a negative impact on the alloys' high temperature Ultimate Tensile Strength (UTS), as depicted by the alloy plots indicated by reference lines 15, 20, 25, and 30. It is further noted that as the Cu concentration of the alloy is decreased to less than approximately 2 wt % the incorporation of Zn has a positive impact on the alloys' high temperature Ultimate Tensile Strength (UTS), as depicted by the alloy plots indicated by reference lines 35, 40, 45, and 50. Without wishing to be bound by theory, it is believed that negative impact of Zn on the strength of alloy compositions having high Cu content is the result of particles formed by the interaction of the Zn and Cu, wherein the undesirable particles do not dissolve into solution during the solution heat treat of the T6 heat treatment process. It is believed that the undissolved particles decrease the strength and elongation properties of the casting.

Still referring to FIG. 6, in some embodiments of the present invention, alloys comprising 0.6 wt % Mg have a greater high temperature Ultimate Tensile Strength (UTS), depicted by the alloy plots indicated by reference lines 15, 25, 35, and 45, than alloys having similar compositions having a Mg concentration on the order of about 0.5 wt %, as depicted by the alloy plots indicated by reference lines 20, 30, 40, and 50.

Referring now to the graph depicted in FIG. 7, The high temperature Elongation (%) is plotted for alloy compositions of varying Mg and Cu concentrations as a function of increasing Zn concentration (wt %). Specifically, reference line 55 indicates a plot of an alloy in accordance with the present invention comprising approximately 0.6 wt % Mg and 3 wt % Cu; reference line 60 indicates a plot of an alloy in accordance with the present invention comprising approximately 0.5 wt % Mg and 3 wt % Cu; reference line 65 indicates a plot of an alloy in accordance with the present invention comprising approximately 0.6 wt % Mg and 2 wt % Cu; reference line 70 indicates a plot of an alloy in accordance with the present invention comprising approximately 0.5 wt % Mg and 2 wt % Cu; reference line 75 is a plot of an alloy in accordance with the present invention comprising approximately 0.6 wt % Mg and 1 wt % Cu; reference line 80 is a plot of an alloy in accordance with the present invention comprising approximately 0.5 wt % Mg and 1 wt % Cu; reference line 85 is a plot of an alloy in accordance with the present invention comprising approximately 0.6 wt % Mg and 0 wt % Cu; and reference line 90 is a plot of an alloy in accordance with the present invention comprising approximately 0.5 wt % Mg and 0 wt % Cu.

According to the graph depicted in FIG. 7, as well as, the data provided in Table 3, it is noted that increasing the Cu content within the inventive alloy has a negative impact on the alloy's elongation. For example, referring to the plots indicated by reference lines 55, 65, 75, and 85, in which the Mg concentration in each alloy is equal to 0.6 wt %, as the Cu concentration is increased the elongation of the alloy is reduced. Additionally, the Cu concentration has a similar effect on the alloys depicted by reference lines 60, 70, 80 and 90, in which the Mg concentration in each alloy is equal to about 0.5 wt %.

Still referring to Table 3 and FIG. 7, in one embodiment of the present invention, increases in Zn content within the inventive alloy can increase the alloy's elongation when the magnesium content is low, such as on the order of 0.5 wt %, as plotted in reference lines 60, 70, 80, and 90. In one embodiment of the present invention, increases in Zn content within the inventive alloy can decrease the elongation of the alloy when the magnesium content is high, such as on the order of 0.6 wt %, as plotted in reference lines 55, 65, 75, and 85. Magnesium has a positive impact on elongation when the Zn content is more than 2.5 wt % and has a negative impact when the Zn content is less than 2.5 wt %. For example, referring to the plots indicated by reference lines 55 and 60, in which the Cu concentration in both alloys is equal to 3.0 wt %, as the Mg concentration is increased from 0.5 wt % to 0.6 wt % the Quality Index (Q) is increased if the Zn content of the alloy is greater than or equal to 2.5 wt %. Additionally, the Mg concentration has a similar effect on the alloys with less than 3.0 wt % Cu.

Referring now to the Graph depicted in FIG. 8, the Quality Index (Q) of AlSiMg alloys in accordance with the present invention at high temperature (150° C.) with varying concentrations of Cu and Mg are plotted as a function of Zn content. Specifically, reference line 95 indicates a plot of an alloy in accordance with the present invention comprising approximately 0.5 wt % Mg and 3 wt % Cu; reference line 100 indicates a plot of an alloy in accordance with the present invention comprising approximately 0.5 wt % Mg and 2 wt % Cu; reference line 105 indicates a plot of an alloy in accordance with the present invention comprising approximately 0.6 wt % Mg and 3 wt % Cu; reference line 110 indicates a plot of an alloy in accordance with the present invention comprising approximately 0.5 wt % Mg and 1 wt % Cu; reference line 115 is a plot of an alloy in accordance with the present invention comprising approximately 0.6 wt % Mg and 2 wt % Cu; reference line 120 is a plot of an alloy in accordance with the present invention comprising approximately 0.5 wt % Mg and 0 wt % Cu; reference line 125 is a plot of an alloy in accordance with the present invention comprising approximately 0.6 wt % Mg and 1 wt % Cu; and reference line 130 is a plot of an alloy in accordance with the present invention comprising approximately 0.6 wt % Mg and 0 wt % Cu. As indicated above, the Quality Index (Q) is a calculated index which includes the Ultimate Tensile Strength (UTS) plus a term involving the logarithm of the Elongation (E).

Referring to FIG. 8 and the data depicted in Table 3, although the Cu content generally increases the alloys of the present invention Ultimate Tensile Strength (UTS) and/or Tensile Yield Strength (TYS), Cu generally decreases elongation and therefore in some embodiments may decrease the alloy's Quality Index (Q). Mg typically has a positive impact on Quality Index of the alloys of the present invention including Cu and Zn, wherein Zn content is greater than or equal to 1.2 wt %. For example, referring to the plots indicated by reference lines 95 and 105, in which the Cu concentration in both alloy is equal to 3.0 wt %, as the Mg concentration is increased from 0.5 wt % to 0.6 wt % the Quality Index (Q) is increased if the Zn content of the alloy is greater than or equal to 1.2 wt %. Additionally, the Mg concentration has a similar effect on the alloy with less than 3.0 wt % Cu. In some embodiments of the present invention, AlSiMg alloys comprising increased Cu concentrations, such as the alloy plots indicated by reference lines 95, 100, 105, and 120, have decreasing Quality Index (Q) values as the concentration of Cu is increased. In some embodiments of the present invention, the incorporation of Zn can increase the Quality Index (Q) of the alloy when the Mg content is on the order of about 0.6 wt %, and the Cu is content is less than about 2.5 wt %, as depicted by the alloy plots indicated by reference numbers 115, 125, and 130.

Although the alloy compositions listed in Table 3 are illustrative of the inventive composition, the invention should not be deemed limited thereto as any composition having the constituents and ranges recited in the claims of this disclosure are within the scope of this invention. Further examples of alloy compositions that are within the scope of the present invention are listed within the Table depicted in FIG. 9. FIG. 9 also includes the Tensile Yield Strength (TYS), Ultimate Tensile Strength (UTS), Elongation (E), and Quality Index (Q) of the listed alloy compositions listed, wherein the TYS, UTS, E, and Q were taken from T6 temper test samples at room temperature (22° C.).

The final row of the Table in FIG. 9 includes the composition and room temperature (22° C.) mechanical properties (Tensile Yield Strength (TYS), Ultimate Tensile Strength (UTS), Elongation (E), and Quality Index (Q)) of an E357 alloy test specimen at T6 temper (E357-T6) that was formed by investment casting, wherein the E357 alloy test specimen is prior art that has been incorporated for comparative purposes. Still referring to FIG. 9, E357 has an Ultimate Tensile Strength (UTS) at 22° C. on the order of 275 MPa and an Elongation (E) of approximately 5%. At temperatures of approximately 150° C., investment cast and T6 temper test samples of E357 have an Ultimate Tensile Strength (UTS) of 260 MPa, a Tensile Yield Strength of 250 MPa, an Elongation (E) of approximately 7% and a Quality Index of 387 MPa.

In one embodiment of the present invention, the inventive aluminum alloy comprising 4%-9% Si, 0.1%-0.7% Mg, less than 5% Zn, less than 0.15% Fe, less than 4% Cu, less then 0.3% Mn, less than 0.05% B and less than 0.15% Ti, has an Ultimate Tensile Strength (UTS) for investment castings with a T6 heat treatment at applications on the order of 150° C. that is 20% to 30% greater than similiarly prepared castings of E357.

In one preferred embodiment of the inventive alloy, in which the Cu content is less than or equal to 2 wt % and the Zn content ranges from 3 wt % to 5 wt %, the Ultimate Tensile Strength (UTS) for investment castings with a T6 heat treatment at applications on the order of 150° C. that is 10% to 20% greater than similiarly prepared and tested castings of E357.

In another embodiment of the inventive alloy, in which the Cu content is greater than 2 wt % and Zn is not present, or present in an amount less than 3%, the Ultimate Tensile Strength (UTS) for investment castings with a T6 heat treatment at applications on the order of 150° C. that is 20% to 30% greater than similiarly prepared and tested castings of E357.

For alloys having a high Tensile Yield Strength (TYS) and high Ultimate Tensile Strength (UTS), an alloy containing about 7% Si, about 0.45% to about 0.55% Mg, about 2-3% Cu and about 0% Zn is recommended.

For alloys having a high Tensile Yield Strength (TYS) and high Ultimate Tensile Strength (UTS), an alloy containing about 7% Si, about 0.55% to about 0.65% Mg, less than 2% Cu and between 3%-5% Zn is recommended.

For alloys having both good strength and good elongation, an alloy containing about 7% Si, about 0.5% Mg, very little Cu, and about 4% Zn is recommended.

For an alloy with good fluidity, an alloy containing about 7% Si, about 0.5% Mg, about 3% Cu and 4% Zn is recommended.

The above data is suggestive of a family of casting alloys having various desirable properties. The different desirable properties are appropriate for different applications.

Alloys according to the present invention may be cast into useful products by investment casting, low pressure or gravity casting, permanent or semi-permanent mold, squeeze casting, high pressure die casting, or sand mold casting.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

We claim:

1. An aluminum casting alloy consisting essentially of, in weight percent:

about 6.8% to about 9% Si;
about 0.1% to about 0.7% Mg;
about 3% to about 5% Zn;
less than about 0.15% Fe;
less than 2.0% Cu;
less than about 0.3% Mn;
less than about 0.05% B; and
less than about 0.15% Ti, the balance being essentially aluminum, incidental elements and impurities.

2. The aluminum casting alloy of claim 1 wherein said Cu is present in less than or equal to about 1.0% and said Zn is present in a range from about 3% to about 5%.

3. The aluminum casting alloy of claim 2 wherein said Mg is present at about 0.55 to about 0.65% and said Si has a concentration of about 7%.

4. The aluminum casting alloy of claim 1 wherein said Mg is present at about 0.45 to about 0.55% and said Si has a concentration of about 7%.

5. The aluminum alloy casting of claim 1 having increased strength properties in comparison to castings of E357 alloy.

6. The aluminum casting alloy of claim 1 wherein said aluminum casting alloy is cooled at a rate of less than about 0.5° C. per second.

7. The aluminum casting alloy of claim 1 wherein said aluminum casting alloy having a dendritic arm spacing greater than or equal to about 60 microns.

8. A shaped casting consisting essentially of, in weight percent:

about 6.8% to about 9% Si;
about 0.1% to about 0.7% Mg;
about 3% to about 5% Zn;
less than about 0.15% Fe;
less than 2.0% Cu;
less than about 0.3% Mn;
less than about 0.05% B; and
less than about 0.15% Ti, the balance being essentially aluminum, incidental elements and impurities.

9. A shaped casting, according to claim 8, heat treated to a T5 condition or to a T6 condition.

10. The shaped casting of claim 9 wherein said Cu is present in less than or equal to about 1.0%, said Zn is present in a range from about 3% to about 5%, said Mg is present at 0.55 to 0.65% and said Si has a concentration of about 7%.

11. The shaped casting of claim 10 wherein at high temperatures said shaped casting heat treated to said T6 condition has an ultimate tensile strength 10% to 20% greater than similarly processed castings formed of E357 alloy.

12. The shaped casting of claim 11 wherein said high temperatures range from 100° C. to 250° C.

13. The shaped casting of claim 9 wherein at high temperatures said shaped casting heat treated to said T6 condition has an ultimate tensile strength 20% to 30% greater than similarly processed castings formed of E357 alloy.

14. The shaped casting of claim 13 wherein said high temperatures range from 100° C. to 250° C.

15. The shaped casting of claim 8 wherein said shaped casting is cooled at a rate of less than about 0.5° C. per second.

16. The shaped casting of claim 8 wherein said shaped casting having a dendritic arm spacing greater than or equal to about 60 microns.

17. A method of making a shaped aluminum alloy casting, said method comprises of:

preparing a molten metal mass consisting essentially of, in weight percent:
about 6.8% to about 9% Si;
about 0.1% to about 0.7% Mg;
about 3% to about 5% Zn;
less than about 0.15% Fe;
less than 2.0% Cu;
less than about 0.3% Mn;
less than about 0.05% B; and
less than about 0.15% Ti, the balance being essentially aluminum, incidental elements and impurities;
and forming an aluminum alloy product from said molten metal mass.

18. The method of claim 17 wherein forming said aluminum alloy product comprises casting said molten metal mass into an aluminum alloy casting by investment casting, low pressure or gravity casting, permanent or semi-permanent mold, squeeze casting, die casting, directional casting or sand mold casting.

19. The method of claim 18 further comprising preparing a mold with chills and risers; and casting said molten metal mass in said mold to form said aluminum alloy product.

20. The method of claim 17 further comprising heat treating said casting to a T5 condition or a T6 condition.

21. The method of claim 17 wherein said Cu is present in less than or equal to about 1.0% said Zn is present in a range from about 3% to about 5%, said Mg is present at 0.55 to 0.65% and said Si has a concentration of about 7%.

22. The method of claim 17 wherein said molten metal mass comprises a thixotropic metal mass and said forming said aluminum alloy product comprises semi-solid casting or forming.

23. The method of claim 17 further comprising cooling said molten metal mass at a rate of less than about 0.5° C. per second.

24. The method of claim 17 wherein said molten metal mass having a dendritic arm spacing greater than or equal to about 60 microns.

25. An aluminum casting alloy with alloying elements consisting essentially of, in weight percent:

about 6.8% to about 9% Si;

about 0.5% Mg;

about 2% to about 5% Zn; and the balance being essentially aluminum.

* * * * *